US005080729A

United States Patent [19]

Van Den Sype et al.

[11] Patent Number: 5,080,729

[45] Date of Patent: Jan. 14, 1992

[54] PROCESS FOR RAPID QUENCHING IN A COLLAPSED BED

[75] Inventors: Jaak S. Van Den Sype, Scarsdale; Mark A. Delano, Briarcliff Manor, both of N.Y.

[73] Assignee: Union Carbide Industrial Gases Technology Corporation, Danbury, Conn.

[21] Appl. No.: 119,088

[22] Filed: Nov. 10, 1987

[51] Int. Cl.[5] ..... C21D 1/56

[52] U.S. Cl. ..... 148/13.1; 148/16; 148/20.3; 148/143; 432/15

[58] Field of Search ..... 148/13, 13.1, 16, 20.3, 148/143

[56] References Cited

U.S. PATENT DOCUMENTS

| | | | |
|---|---|---|---|
| 3,197,328 | 7/1965 | Jung et al. | 266/252 |
| 4,300,936 | 11/1981 | Quittevere | 65/114 |
| 4,372,774 | 2/1983 | Cross | 65/114 |
| 4,612,065 | 9/1986 | Kuhn | 148/16 |
| 4,717,433 | 1/1988 | Weisert | 148/20.3 |

FOREIGN PATENT DOCUMENTS

| | | | |
|---|---|---|---|
| 3429707 | 9/1985 | Fed. Rep. of Germany . | |
| 2440994 | 7/1980 | France | 266/252 |
| 46-027934 | 5/1971 | Japan . | |
| 56-199840 | 1/1981 | Japan . | |

OTHER PUBLICATIONS

R. Gupta and A. S. Mujumdar, The Canadian Journal of Chemical Engineering, vol. 58, pp. 332-338, Jun. 1980, A. I. Tamarin, I. I. Kal'tman.

L. A. Vasil'ev, "Vibrofluidized Bed for Quenching", Metallovendenie & Termicheskaya Obrabotka Metallov, No. 3 pp. 10-11, 3/68.

Metals Handbook, 9th ed., vol. 4, Heat Treating, pp. 299-306, 1981.

*Primary Examiner*—Melvyn J. Andrews
*Assistant Examiner*—Margery S. Phipps
*Attorney, Agent, or Firm*—Peter Kent

[57] ABSTRACT

A method of rapidly quenching articles in a fluidized bed or in a collapsed bed, wherein the bed comprises fine solid particles. A high conductivity gas may be used to transfer heat to or from the fluidized bed or the collapsed bed during at least a portion of the quenching. The high conductivity gas may be used to fluidize the bed during at least a portion of the quenching. The rate of heat transfer from or to the article quenched is improved by moving the article being quenched relative to the quenching bed or by moving the quenching bed about the article.

7 Claims, 3 Drawing Sheets

PROCESS FOR RAPID QUENCHING IN A COLLAPSED BED

BACKGROUND OF THE INVENTION

1. Technical Field

This invention is concerned with a method of quenching articles in a fluidized bed. It is especially useful for hardening particular metal alloys which exhibit reduced hardenability due to their alloy composition.

2. Background Art

Quenching of an article to affect the physical structural phases of the article is well known in the art. Quenching is generally understood to be a sudden change in temperature of the article. "Up-quenching" is a rapid increase in temperature, whereas "down-quenching" is a rapid decrease in temperature.

Quenching can be achieved in a number of different manners whereby a means is provided for rapid heat transfer to or from the article being quenched. If the article is quenched too rapidly, stresses may build up in the article causing undesired structural defects. Conversely, slow quenching can result sin the formation of several different physical/morphological structures within the article being quenched; typically the surface physical structure differs from the internal physical structure of the article, particularly for thick-wall structures. For many applications it is desired to maintain a constant physical structure throughout the article to avoid stress concentration.

Quenching of metals and alloys thereof for purposes of obtaining desired physical crystalline structures within the metal/alloy requires careful control over the quench rate. Fluidized beds have been used successfully to provide uniform, controlled heat transfer mediums for quenching purposes. The present applicants previously disclosed a process for quenching articles in a fluidized bed in U.S. patent application, Ser. No. 913,320, filed Sect. 30, 1986, which is hereby incorporated by reference into the present application. The disclosed process is shown to be particularly useful for quenching steel alloys to provide a particular crystalline structure, avoiding the formation of undesirable softer phases within the article. However, there are certain steels, particularly those comprising low overall carbon contents, below about 0.45 weight percent carbon, and those comprising low alloy metal contents combined with a carbon content of less than about 0.3 weight percent, which can be better quenched using the improvement over the method of U.S. Ser. No. 913,320 which is provided by the present invention. In addition, quenching throughput rate can be increased in general by use of the present invention, which provides an increased heat transfer coefficient between the article being quenched and the fluidized bed heat transfer medium.

Other known related art described fluidized bed characteristics and/or various methods used in the quenching of articles or workpieces. Such art includes U.S. Pat. No. 4,612,065 to Kühn; U.S. Pat. No. 4,300,936 to Quilleuere et al.; U.S. Pat. No. 4,372,774 to Cross et al.; German Pat. DE 3429707 to Schwing et al.; Japanese Patent Application No. 81-199840; and Japanese Patent Application No. 71027934. R. Gupta and A. S. Mujumdar describe the aerodynamics of a vibrated fluid bed in the Canadian Journal of Chemical Engineering, Vol. 58, pp. 332–338, June 1980. Additional information regarding vibrated fluidized beds is provided by A. D. Tamarin, I. I. Kal'tman and L. A. Vasil'ev in an article titled "Vibrofluidized Bed for Quenching", translated from Metallovedenie & Termicheskaya Obrabotka Metallov, No. 3, pp. 10–11, March 1968.

The latter article by Tamarin et al. discusses the use of fluidized bed vibration to improve the heat exchange rate during quenching of a copper ball. The copper ball was heated to about 850° C. and then rapidly immersed into a vibrofluidized bed of particles. Corundum (average particle size 45.9μ) and sand (average particle size 201.6μ) were placed in cylindrical tanks 140mm in diameter which were subjected to vertical vibration at a frequency of 16 cps at an amplitude of 3–6mm. The authors claim to have obtained high heat transfer rates, and from the curves published in the article, the apparent heat transfer rate is about 300 BTU/hr. ft$^2$° F. (0.170 joules/sec. cm$^2$° C.) at about 600° C. (1,110° F.). The high heat transfer rate reported may in part be due to the very high thermal conductivity of copper. The article is silent regarding the gas used to fluidize the bed, which is, then, presumed to be air or nitrogen.

Applicants' laboratory experiments indicate a heat transfer rate of about 150–180 BTU/hr ft $^2$° F. should be obtained for a nickel sphere down quenched under the conditions described by A. I. Tamarin et al. This presumes nitrogen or air is used as the fluidizing gas in the fluidized bed.

All of the above related art describes fluid bed characteristics and methods of operating fluid beds directed toward generation of more rapid heat transfer between the article being treated and the fluidized bed. However, the technology disclosed does not provide sufficiently high heat transfer rates to enable quenching of carbon steels comprising low overall carbon content (for example, steels such as 1045, 1050, 1140 and 1524) at a sufficiently rapid rate to provide a desired crystalline structure while avoiding the formation of softer phases within the article. Examples of alloy steels for which similar problems occur during quenching include 4130, 4120 and 5130.

It is desired, then, to provide a combination of fluidized bed parameters which generates an improved heat transfer rate sufficient to enable quenching of low carbon and low alloy content steels without the formation of softer phases within the article. The improved heat transfer rate is, of course, an advantage in the quenching of metals other than steel, such as heat-treatable aluminum alloys, and in the quenching of nonmetallic materials.

The method of the present invention discloses a combination of fluidized bed parameters which provides an unexpected improvement in the heat transfer rate between the articles being treated and the fluidized bed. Although some of the parameters are discussed individually in known related art, it is a particular combination of parameters not previously disclosed, including one parameter not previously known to provide a significant advantage. which generates the present unexpected improvement.

SUMMARY OF THE INVENTION

In accordance with the present invention, a method is provided which enables rapid quenching of articles treated using a fluidized bed. The article to be treated is placed in a bed comprised of fine solid particles. A gas is used to exchange heat with the fine solid particles.

The gas can be used to fluidize the fine solid particles, provided the flow rate of the gas is at least equal to the minimum fluidization flow rate. The bed temperature is maintained at a temperature below the desired article temperature when the article to be treated is to be cooled, or is maintained at a temperature above the desired article temperature when the article to be treated is to be heated. The heat transfer rate within the bed is increased by moving the part being treated relative to the bed. The part can be moved within the bed or the bed can be moved about the part. However, when the bed is fluidized (the gas flow rate is at least equal to the minimum fluidization flow rate), moving the bed is not as helpful as moving the part within the bed because of the poor coupling between the suspended, fluidized particles. (Only the peripheral particles experiencing actual contact with the moving bed are significantly affected by moving the bed.)

In the case of a collapsed bed with some gas moving through it, moving the bed about the article being treated provides a more significant improvement in heat transfer rate, as the coupling between the collapsed particles in the bed is adequate.

The velocity of bed motion or part motion can be adjusted in proportion to maximum part dimension, however the preferred velocity of motion is at least about 4 inches per second (10.2cm/sec.). The velocity may be defined in terms of a motion having an amplitude and a frequency. For example a back and forth motion of at least about one half inch (1.3cm) amplitude at a frequency of about 8 cycles per second will produce a velocity of motion of about 8 inches per second.

Various combinations of amplitude and frequency and various paths of motion can be used to obtain the desired velocity of the part to be quenched relative to the bed. Applicants have observed amplitudes greater than about one half inch (1.3cm) to be more effective. The maximum velocity which ca be used is that which will not permanently deform the part.

It is believed the direction of motion of the part relative to the bed is not critical, given homogeneous bed. However, regarding fluidized beds, a part having a cross sectional shape which causes shadowing to occur may require the design of a particular direction of part motion to reduce the amount of shadowing. Shadowing is the phenomenon whereby portions of the bed particles are not contacted by the fluidizing gas due to orientation of the part in the bed relative to the direction of fluidizing gas flow within the bed; as a result, non-fluidized particles settle out upon the surface of the part, creating the shadowing condition. For example, experimentation has demonstrated that for a fluidized bed having vertical fluidizing gas flow, a vertical up and down motion provides slightly better heat transfer for a cylindrical part than motion at an angle to the direction of fluidizing gas flow.

The gas can be used for fluidization and/or heat transfer within the bed during the entire quench period or for a portion of the quench period. The gas in a collapsed bed provides heat transfer between the gas and the bed particles, wherein the majority of heat transfer occurring between the bed and the part occurs as heat transfer between the bed particles and the part. The heat transfer between the bed particles and the part is improved by moving the bed about the part or the part within the bed.

The gas used for fluidization and/or heat transfer may be a high conductivity gas, which further improves the heat transfer characteristics of the bed. Examples of high conductivity gases, not intended to be limiting, include hydrogen, helium and disassociated ammonia.

As used herein, the term "quenching" means a rapid change in enthalpy of an object by heat transfer across the boundary of the object.

As used herein, the term "fine solid particles" means porous or non porous particles having a mean particle diameter within the range of from 30 to 1,000 microns.

As used herein, the term "bed" means a defined volume comprising a fluid component and a fine solid particles component. The "bed" may be either a "fluidized bed" or a "collapsed bed" as described below. The defined volume may be moved from its initial coordinates to different coordinates, whereby the motion of a particular portion of the fluid component contained in the defined volume or the motion of a particular portion of the fine solid particles component contained in the defined volume is altered as a function of the coupling effect between the components, the magnitude of the coordinate change, and the time period over which the coordinate change is accomplished.

As used herein, the term "fluidized bed" means a bed through which fluid is passed, wherein the fluid drag force of the fluid component causes movement of the solid component from its repose position in a manner that enhances mixing of both components in the bed. The term, fluidized, is derived from the fluid-like characteristics, such as zero angle of repose, mobility, and a pressure head equal to the bulk density of the bed, which the bed assumes.

As used herein, the term "collapsed bed" means a bed through which a fluid is passed at a volumetric rate which is below that necessary to fluidize the bed, whereby heat transfer occurs between the solid component of the bed and the fluid component of the bed without significant movement of the solid component from its repose position.

As used herein, the term "minimum fluidization flow rate" means the lowest volumetric flow rate of the fluid component through a bed which is necessary for the bed to attain fluidized bed characteristics under atmospheric pressure.

As used herein, the term "high conductivity gas" means a gas, gas mixture, vapor, vapor mixture or gas-vapor mixture having a thermal conductivity greater than or equal to the thermal conductivity of a mixture of 80 percent nitrogen and 20 percent helium at the same temperature and pressure.

As used herein, the term "velocity" means the time rate of motion of the bed and the article being treated relative to each other.

As used herein, the term "amplitude" means the maximum value of the displacement in an oscillatory motion.

As used herein, the term "cycles per second" means the number of complete performance of an oscillation or other periodic process which occur in one second.

Curve A shows the heat transfer rate when helium is used as the fluidizing gas and the part (nickel ball) within the bed is not in motion relative to the bed. Two different sized beds were evaluated in obtaining the data for Curve A, a laboratory-sized bed about 6 inches in diameter and about 1 ft. high, and an industrial-sized bed about 3 feet in diameter and about 5 ft. high. Bed size had no effect on the curve at helium gas flow rates up to fifteen times the minimum fluidizing flow rate.

Curve B shows the heat transfer rate under the same conditions as Curve A, for the laboratory sized bed, except that the part is moved relative to the bed at a velocity of about 10 inches per second (25.4 cm/sec.).

Curves C and C' show the heat transfer rate when nitrogen is used as the fluidizing gas and the part within the bed is not in motion relative to the bed. Curve C shows the data for the 1 ft. high laboratory sized bed and Curve C' shows the data for the 5 ft. high industrial sized bed. The difference between curves C and C' indicates the deleterious effect of bubble formation in the large bed on the heat transfer rate when nitrogen is used as the fluidizing gas.

Curve D shows the heat transfer rate under the same conditions as Curve C, wherein the fluidizing gas is nitrogen, except that the part is moved relative to the bed at a velocity of about 10 inches per second.

Figure 2:
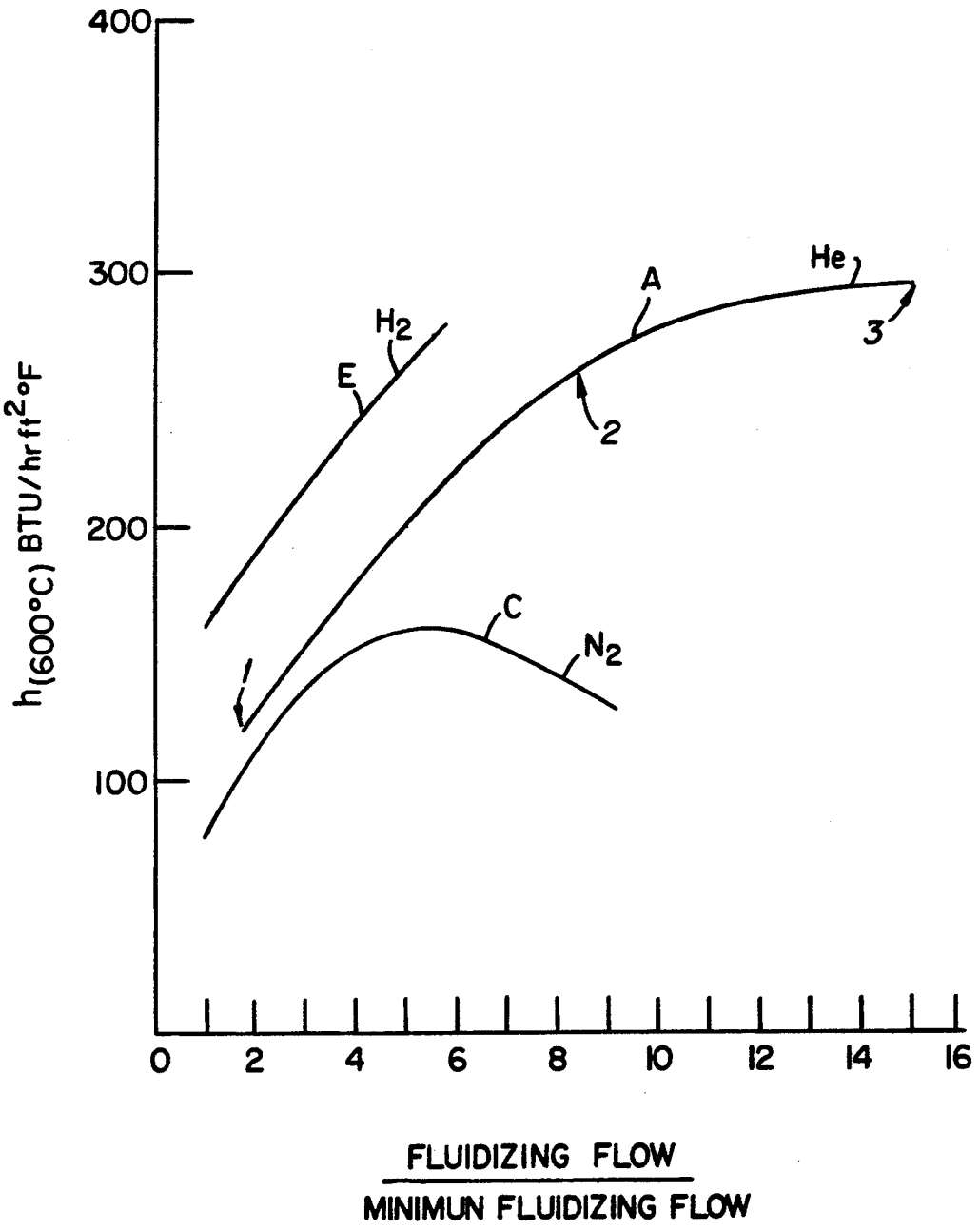

FIG. 2 illustrates the difference in heat transfer rate obtained as a function of the type of fluidized gas. The ⅞ in. diameter nickel ball was down quenched in the 1 ft. high laboratory sized fluidized bed comprised of alumina particles. Curve A shows the heat transfer rates as a function of the ratio of helium fluidizing gas flowrate to minimum helium fluidizing gas flow rate. Curve C shows the heat transfer rates for nitrogen fluidizing gas. Curve E shows the heat transfer rates for hydrogen fluidizing gas. Hydrogen and Helium fall within the definition of "high conductivity gas" as defined herein, whereas nitrogen does not fall within the same definition.

Figure 3:
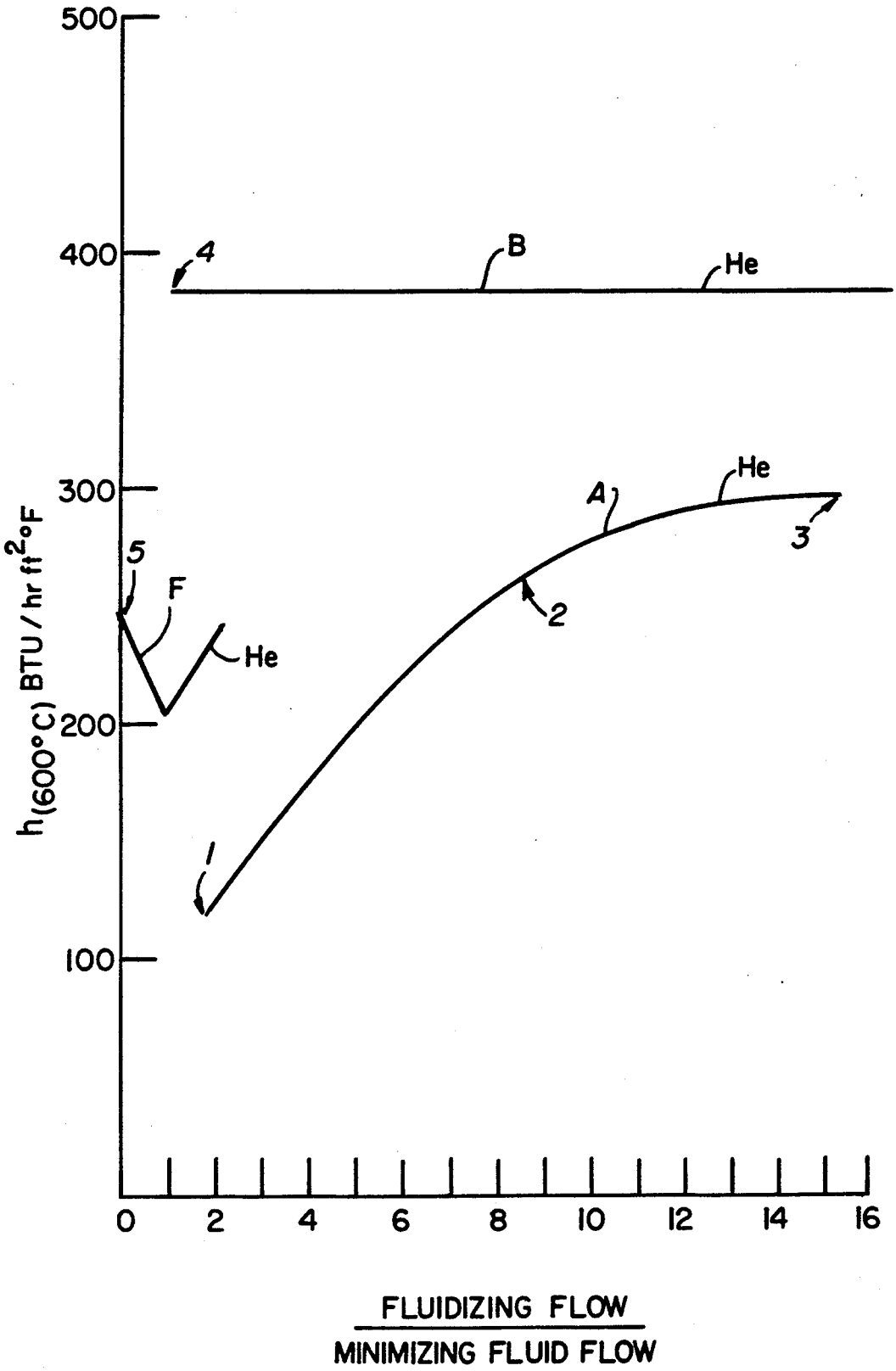

FIG. 3 shows heat transfer rates obtained using different beds, and different motion conditions wherein helium is the gas used to provide heat transfer and/or fluidization. Curve A shows data obtained using the 1 ft. high laboratory sized fluidized bed, wherein the bed and the ⅞ in. diameter nickel ball are not in motion relative to each other. Curve B shows data obtained using the 1 ft. high laboratory-sized fluidized bed, wherein the ⅞ in. diameter nickel ball is moved relative to the bed at a velocity of about 10 inches per second (25.4 cm/sec.). Curve E shows data obtained using a vibrating bed with the nickel ball at a stationary position in the center of the bed. The vibrating bed was about 6 inches in diameter and about 1 ½ feet tall. The amplitude of vibration was about ⅛ inch (0.32 cm) and the frequency of vibration was about 20 cycles per second.

DETAILED DESCRIPTION OF THE INVENTION

U.S. patent application Ser. No. 913,320, filed Sept. 30, 1986, assigned to the assignee of the present invention and previously incorporated by reference herein, provides a process for rapid quenching in a fluidized bed. The process uses a fluidized bed comprised of: porous or non porous particles having a density within the range of from 0.3 to 20 grams per cubic centimeter, and a mean particle diameter within the range of from 30 to 1000 microns; which particles are fluidized using a high conductivity gas comprising a gas, gas mixture, vapor, vapor mixture, or gas vapor mixture having a thermal conductivity greater than or equal to the thermal conductivity of a mixture of 80 percent nitrogen and 20 percent helium at the same temperature and pressure. The high conductivity gas flow rate through the fluidized bed is at least 1.5 times the minimum fluidization flowrate for the bed. The above combination of particle density and size, high conductivity gas and high fluidizing flow rate made possible high heat transfer rates ranging from about 120 to about 320 BTU/hr.ft$^{2°}$ F. (0.068 0.181 joules/sec. cm $^{2°}$ C.).

COMPARATIVE EXAMPLE

For purposes of later comparison, an experiment comprising a process similar to that described in U.S. patent application Ser. No. 913,320, was conducted as follows: a nickel test sphere about ⅞ inch in diameter was down quenched using the procedure known in the art as the Magnetic Test, General Motors Quenchometer Test, or Nickel Ball Test. The General Motors procedure comprised heating the ⅞ in. (22 mm) diameter nickel sphere, weighing approximately 1.8 ounces (50g) to a given high temperature than then down quenching the sphere in the quenchant to be evaluated down to a given low temperature. The time required for the nickel sphere to go from the high to the low temperature was measured as the quench rate. The temperature range over which the quench rate was measured was between 1544° F. and 616° F. (840° C. and 360° C.).

The fluidized bed used was a laboratory-sized bed about 6 inches in diameter and about 1 foot high. The bed fine solid particles comprised alumina particles having a mean particle diameter of about 60 microns. Helium gas was used for heat transfer and fluidization. The fluidizing gas flow rate was about 1.7 times the minimum necessary to place the bed in a fluidized condition (about 40 SCFH).

The heat transfer rate was about 120 BTU/hr.ft $^{2°}$ F. (0.0680 joules/sec. cm $^{2°}$ C.), which is shown as 1 on Curve A in FIG. 1.

Figure 1:
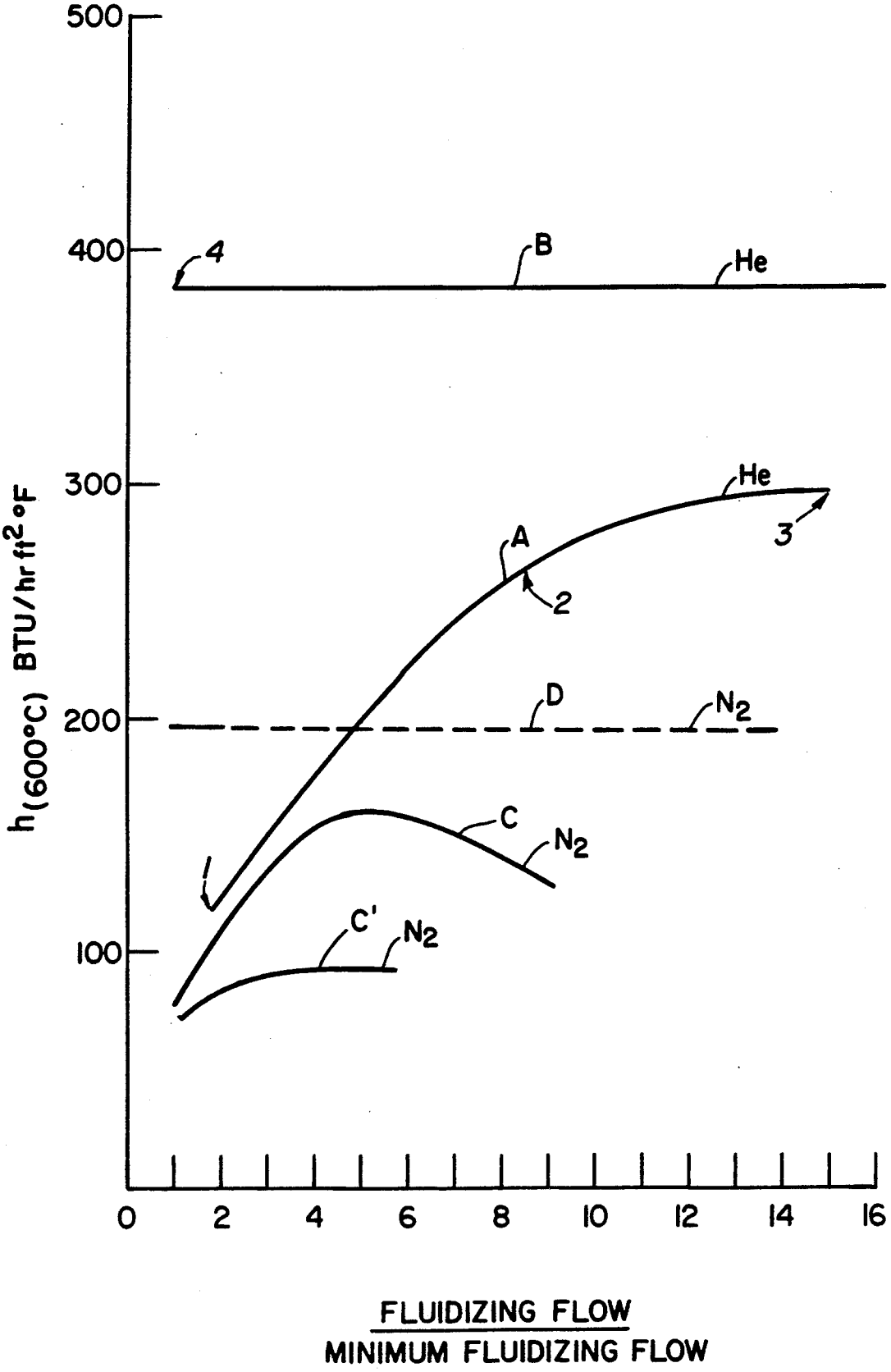
FIG. 1 shows the heat transfer rate obtained on quenching a $\frac{7}{8}$ in. diameter nickel ball in a fluidized bed comprised of alumina particles, as a function of the ratio of fluidizing gas flow rate to minimum fluidizing gas flow rate.

The heat transfer rates plotted in FIG. 1 are the rates measured at about 1112° F. (600° C.). For hardening of steel parts, the cooling rate at this 600° C. temperature is critical, since it corresponds to the nose temperature of the time, temperature, transformation (TTT) diagram for many steel alloys. TTT diagrams are shown in U.S. Patent Application Ser. No. 913,320 and can be found in the art for various other materials. The nose temperature, as used herein, means the temperature at which the time required for a given crystalline structure to start transforming into softer phases is at a minimum. In the case of steel, it is the temperature at which the time required for austenite to begin transforming into softer phases is at a minimum. Thus, during down quenching, it is desirable to have a high heat transfer rate at the nose temperature, reducing the time the article being down quenched is at the nose temperature, thereby reducing the amount of undesired softer phase material formed during down quenching.

Substantial increase in the heat transfer rate was obtained by increasing the helium fluidizing gas flow rate up to about 15 times the minimum fluidizing flow rate, at which gas flow rate the heat transfer rate was about 300 BTU/hr-ft $^{2°}$ F. (0.170 joules/sec. cm $^{2°}$ C.) as shown at 3 on Curve A in FIG. 1. However, fluidizing gas flow rates as high as 15 times the minimum fluidizing flow rate are impracticable due to the substantial portion of bed particles carried out at such flow rates. In practice, a flow rate of about 7 to 10 times the minimum fluidizing flow is acceptable. The heat transfer rate measured at a fluidizing gas flow rate of about 8.5 was about 260 BTU/hr-ft 2° F. (0.146 joules/sec. cm 2° C.), as shown at 2 on Curve A.

The improvement in heat transfer rate with increasing gas velocity is in large part due to the increased motion of the bed particles with respect to the part being quenched. However, there are two disadvantages to increasing gas velocity: 1. It is expensive, since the high conductivity gas, such as the helium used in this example to agitate the particles is expensive, and 2. the maximum heat transfer improvement is limited due to voidage (increased space between the particulate matter in the fluidized bed) and carry-out of particles from the bed.

THE IMPROVED PROCESS

Example 1

Applicants discovered that a significant improvement in heat transfer rate can be achieved by moving the parts to be quenched rapidly inside the bed while minimizing the fluidizing gas flow rate.

The above described laboratory sized bed comprised of 60 micron sized average diameter alumina particles was fluidized with helium gas at the minimum fluidizing flow. The helium gas and the bed particles were at room temperature to provide for down quenching. A ⅞ inch diameter nickel ball instrumented with a central thermocouple was heated to 1550° F. and then down quenched to 70° F. in the fluidized bed. During quenching, the nickel ball was kept agitated in the bed by rapidly moving it up and down (vertically) within the bed, at an amplitude of about 3 inches and at a frequency of about 1.7 cycles per second, to obtain a velocity (of the part relative to the bed) of about 10 inches per second. The up and down motion of the nickel ball within the bed was accomplished by fastening the ball to a rod which was moved up and down vertically in the bed. The fastening was via a small stainless steel connecting rod which contained a thermocouple wire which extended to the center of the nickel ball. The connecting rod was less than about one eighth (⅛) inch in diameter and heat transfer from the nickel ball through connecting rod was considered negligible in comparison with total heat transfer from the ball. The heat transfer rate from the ball to the fluidized bed was about 385 BTU/hr-ft 2° F. (2.18 joules/sec.cm 2° C.), as shown at 4 on Curve B of FIG. 1.

Example 2

The quenched bed described in Example 1 was used to down quench a 1 inch diameter 4130 steel bar about 4 inches long. The helium flow rate was about three times the minimum fluidizing flow. The helium gas and the fluid bed particles were at room temperature. The bar was heated to about 1550° F. prior to down quenching. The bar was agitated in the bed by moving it up and down at a velocity of about 10 inches per second at an amplitude of about 3 inches. The bar was down quenched to a temperature of 70° F.

Following quenching, the steel bar was sectioned and a hardness profile was measured Maximum hardness (about 0.100 inch below the surface) was 48 RC (on the Rockwell hardness scale). In comparison, an identical steel bar quenched using the same bed fluidized with helium at about 10 times the minimum fluidizing flow and without moving the steel bar within the bed during quenching exhibited a maximum hardness of about 43 RC.

Example 3

FIG. 2 illustrates the effect of fluidizing gas composition on heat transfer rate in a fluidized bed. All of the data was obtained using the laboratory sized bed described above, including the alumina fine solid particles. The heat transfer rate was measured as heat was transferred from the ⅞ inch diameter nickel ball to the bed (down quenching). The data shown represents the heat transfer rate at about 600° C. There was no motion of the nickel ball relative to the bed. Curve A shows the heat transfer rate (in BTU/hr. ft$^2$ ° F.) as a function of the ratio of actual fluidizing gas flow rate to minimum fluidization flow rate when the fluidizing gas was helium. Curve C shows the same heat transfer relationship measured for nitrogen fluidizing gas and Curve E shows the relationship measured for hydrogen fluidizing gas. Hydrogen and helium both fall within the definition of a high conductivity gas as defined herein; nitrogen is not a high conductivity gas. Clearly a significant increase in heat transfer rate was obtained by using a high conductivity gas for heat transfer and fluidization within the bed, with hydrogen providing a higher rate of heat transfer than helium, all other conditions being the same.

Example 4

FIG. 3 illustrates the effect of moving the part being quenched relative to the bed. The laboratory sized bed, about 6 inches in diameter and about 1 foot high was used to generate Curve A and Curve B. A different bed of comparable size, about 6 inches in diameter and about one and one half (1½) feet high, was used to generate Curve F. The bed fine solid particles comprised alumina as previously described, and the fluidizing gas was helium in all cases. The ⅞ inch diameter nickel ball was down quenched and the heat transfer rates given are at about 600° C. in all cases.

Curve A shows the heat transfer rate (in BTU/hr. Ft$^2$° F.) as a function of the ratio of helium fluidizing gas flow rate to minimum helium fluidization flow rate. The nickel ball was not in motion relative to the bed during generation of the data presented in Curve A.

Curve B shows the heat transfer relationship when the nickel ball is moved in a vertical up and down motion within the fluidized bed (fluidizing gas flow being vertical within the bed) at a velocity of about 10 inches per second (25.4 cm/sec). Within the scatter of the data, no improvement in heat transfer rate was observed as the fluidizing gas flow rate was increased up to a ratio of fluidizing gas flow rate to minimum fluidization flow rate of at least 20. Most important was the dramatic increase in heat transfer rate achieved over that which had been obtained when the nickel ball was held stationary within the fluidized bed (Curve A). Thus, moving the nickel ball within the bed enabled a heat transfer rate greater than that previously known while requiring minimal fluidizing gas flow rate through the bed.

Curve F shows the heat transfer relationship when the nickel ball was held stationary in the center of the bed, but the bed itself was vibrated. The amplitude of vibration was about ⅛ inch and the frequency of vibration was about 20 cycles per second. Thus the relative bed velocity was about 5 inches per second (12.7 cm/sec). When the bed was collapsed, and in particular, the ratio of fluidizing gas flow to minimum fluidizing flow was zero (0), the heat transfer rate for the vibrating bed (Curve F) was greater than that obtained for a non vibrating bed (Curve A) up to a fluidizing flow rate of about 7 times the minimum fluidizing flow rate in the non vibrated bed.

Initiation of fluidization in the vibrated bed (Curve F) resulted in a decrease in heat transfer rate, which subsequently recovered to the collapsed bed, zero gas flow heat transfer rate when the ratio of fluidizing gas flow rate to minimum fluidization flow rate reached 2. However, the heat transfer rate obtained using the vibrating bed (Curve F) was far less than that obtained when the nickel ball was moved within a stationary bed at a velocity of about 10 inches per second (Curve B). The lower heat transfer rate demonstrated by comparison of Curve F against Curve B is attributed to at least two factors: (1) a lower relative velocity between the nickel ball and the bed (about 5 inches per second in Curve F, the vibrating bed, compared with about 10.0 inches per second in Curve B, the part moved within a stationary bed) and (2) poor coupling between the fluidized particles, reducing the benefit of the vibrating bed in terms of overall improvement in relative motion between the fine solid particles and the nickel ball. Thus, the bed vibration provided a substantial improvement in heat transfer rate over that obtained for a non-vibrated bed, (see Curve F and Curve A) and moving the nickel ball within a stationary bed provided an additional substantial improvement. (See Curve B and Curve F).

Based on the above Examples, applicants concluded there are three principal advantages to moving the parts within the bed (or, to a lesser extent moving the bed about a suspended part or article to create a similar effect in terms of motion):

1. Higher heat transfer rates can be achieved than can be achieved by solely increasing the fluidizing gas flow rate.

Moving the part within a fluidized bed appears to provide an advantage over moving the bed about the part, due to coupling considerations between fluidized particles within the bed.

2. Moving the part within the bed provides a dramatic improvement in the heat transfer rate at the minimum fluidizing gas flow rate, thus reducing the consumption of high conductivity gases such as helium, hydrogen, disassociated ammonia and other similar gases which are expensive.

Moving the bed about the part may provide a significant improvement in heat transfer rate over that obtained solely by increasing the flow rate of the fluidizing gas flow rate. This improvement in heat transfer rate may depend on bed size, but has been shown to occur in small beds of about 6 inches in diameter and one and one-half (1½) feet in height.

3. Moving the part within a fluidized bed greatly reduces the deleterious effect of shadowing on the overall heat transfer rate. Shadowing being the phenomenon whereby the bed space near certain areas of the part being quenched does not have sufficient bed agitation to keep bed particles moving at the desired velocity. For example, in a bed having fluidizing flow from the bottom of the bed toward the top, a large part placed with its largest area horizontal to the bottom of the bed may create a dead space over the top of the part, wherein there is little gas flow or particle movement. Thus, by moving the part within the bed not only are the total number of bed particles contacting the part surface increased over a given time period, but also bed particles are contacted with all part surfaces.

Experimentation has indicated the amplitude of the motion should be proportional to the part dimensions. Good heat transfer was obtained when the amplitude was approximately equal to the maximum dimension of the part in the direction of motion. For example, a one half (½) inch amplitude is about the minimum which should be used during quenching of a seven eighths (⅞) inch diameter nickel ball.

It is equally clear that the method of the present invention can be used to improve the heat transfer rate from the fluidized bed to the article being quenched during upquenching, wherein the article is heated rather than cooled Only preferred embodiments of the present invention have been described above, and one skilled in the art will recognize that numerous substitutions, modifications and alterations are permissible without departing from the spirit and scope of the invention, as demonstrated in the following claims.

What is claimed is:

1. A method of rapidly quenching at least one article in a collapsed bed, wherein said bed comprises fine solid particles, which are porous or non-porous particles having a mean particle diameter within the range of from 30 to 1,000 microns, and wherein heat transfer to or from said bed is accomplished using a gas, wherein the improvement comprises: causing motion of said at least one article being quenched relative to said collapsed bed by moving said at least one article within said bed and wherein the velocity of said motion is at least about 4 inches per second.

2. A method of rapidly quenching at least one article in a collapsed bed, wherein said bed comprises fine solid particles, which are porous or non-porous particles having a mean particle diameter within the range of from 30 to 1,000 microns, and wherein heat transfer to or from said bed is accomplished during at least a portion of said quenching using high conductivity gas flow through said bed, wherein the improvement comprises: causing motion of said at least one article being quenched relative to said collapsed bed either by moving said at least one article within said collapsed bed or by moving said collapsed bed about said at least one article, and wherein the velocity of said motion is at least about 4 inches per second.

3. The method of claim 1 or claim 2 wherein said motion has an amplitude of at least about one eighth inch.

4. The method of claim 1 or claim 2 wherein said article being quenched is comprised of a steel, and wherein said steel comprises a carbon content of less than about 0.45 weight percent.

5. The method of claim 1 or claim 2 wherein said article being quenched is comprised of a low alloy steel, and wherein said low alloy steel comprises a carbon content of less than about 0.3 percent by weight carbon.

6. The method of claim 1 or claim 2, wherein said article being quenched is comprised of a heat treatable aluminum alloy.

7. The method of claim 2 wherein said high conductivity gas is selected from the group consisting of hydrogen, helium, or disassociated ammonia.

* * * * *